US010322388B2

(12) United States Patent
Reif et al.

(10) Patent No.: US 10,322,388 B2
(45) Date of Patent: Jun. 18, 2019

(54) CONTAINER SYSTEM WITH ONE CONTAINER WITH A FLEXIBLE PARTITION

(75) Inventors: Oscar-Werner Reif, Hannover (DE); Reinhard Baumfalk, Goettingen (DE); Gerhard Greller, Goettingen (DE)

(73) Assignee: Sartorius Stedim Biotech GmbH (DE)

( * ) Notice: Subject to any disclaimer, the term of this patent is extended or adjusted under 35 U.S.C. 154(b) by 0 days.

(21) Appl. No.: 12/226,082

(22) PCT Filed: Apr. 12, 2007

(86) PCT No.: PCT/EP2007/003235
§ 371 (c)(1),
(2), (4) Date: Oct. 6, 2008

(87) PCT Pub. No.: WO2007/124847
PCT Pub. Date: Nov. 8, 2007

(65) Prior Publication Data

US 2009/0314666 A1 Dec. 24, 2009

(30) Foreign Application Priority Data

May 3, 2006 (DE) ..... 10 2006 020 813

(51) Int. Cl.

| | |
|---|---|
| ***B65D 25/00*** | (2006.01) |
| ***B01F 15/00*** | (2006.01) |
| *B01F 7/16* | (2006.01) |
| *B01F 11/04* | (2006.01) |
| *B01F 13/08* | (2006.01) |

(52) U.S. Cl.
CPC .... *B01F 15/0085* (2013.01); *B01F 15/00896* (2013.01); *B01F 7/16* (2013.01); *B01F 11/04* (2013.01); *B01F 13/08* (2013.01); *B01F 2215/0032* (2013.01)

(58) Field of Classification Search
CPC .. B01F 15/0085; B01F 15/00896; B01F 7/16; B01F 11/04; B01F 13/08; B01F 2215/0032
USPC ..... 206/221; 366/307; 220/564, 563, 562, 220/669–675, 654; 215/DIG. 8
See application file for complete search history.

(56) References Cited

U.S. PATENT DOCUMENTS

| | | | | |
|---|---|---|---|---|
| 1,032,663 | A * | 7/1912 | Fay | 366/307 |
| 2,797,903 | A | 7/1957 | Urban | |
| 4,494,878 | A * | 1/1985 | Rainey, Jr. | 366/307 |
| 4,521,116 | A * | 6/1985 | Adsit | 366/54 |
| 4,747,696 | A * | 5/1988 | McCrory et al. | 366/307 |

(Continued)

FOREIGN PATENT DOCUMENTS

| | | |
|---|---|---|
| DE | 2005 062 052 A1 | 6/2005 |
| DE | 10 2004 013 078 A1 | 10/2005 |

(Continued)

*Primary Examiner* — Andrew D Perreault
(74) *Attorney, Agent, or Firm* — Gerald E. Hespos; Michael J. Porco; Matthew T. Hespos

(57) ABSTRACT

Container system with one container (1) with a flexible partition, in particular a disposable container, that can be inserted into a carrying container that supports its lateral container partition (10) and in which liquid medium (8) that has been poured in can be mixed, with the carrying container (4) featuring at least one baffle (15, 15', 15", 15'") on the internal support partition (11) that forms the lateral container partition.

14 Claims, 4 Drawing Sheets

(56) References Cited

U.S. PATENT DOCUMENTS

| | | | | |
|---|---|---|---|---|
| 5,186,827 | A * | 2/1993 | Liberti et al. | 210/222 |
| 5,727,878 | A * | 3/1998 | Sullivan, Jr. | 366/247 |
| 5,800,058 | A * | 9/1998 | Cook | 366/307 |
| 6,109,780 | A * | 8/2000 | Lesniak | 366/307 |
| 6,494,613 | B2 | 12/2002 | Terentiev | |
| 2003/0031085 | A1 | 2/2003 | Baron | |
| 2004/0221897 | A1 | 11/2004 | Schubmehl et al. | |
| 2005/0130291 | A1 | 6/2005 | Erhardt et al. | |
| 2006/0013063 | A1 | 1/2006 | Singh | |
| 2006/0042995 | A1* | 3/2006 | McGrath et al. | 206/583 |

FOREIGN PATENT DOCUMENTS

| | | |
|---|---|---|
| EP | 0 360 456 | 3/1990 |
| EP | 1 214 142 | 6/2003 |
| EP | 0 819 941 | 8/2003 |
| GB | 2 274 404 | 7/1994 |

* cited by examiner

CONTAINER SYSTEM WITH ONE CONTAINER WITH A FLEXIBLE PARTITION

The invention relates to a container arrangement with a container having a flexible wall, in particular a disposable container, which can be inserted into a support container which supports its lateral container wall and in which liquid medium which has been introduced can be mixed thoroughly.

Containers having flexible walls are in particular increasingly being used as flexible disposable containers or mixing bags in the pharmaceutical/biotechnology industry, wherein in a broad range of applications sterile liquids have to be not only decanted, transported and stored, but rather also handled.

DE 10 2004 013 078 A1 discloses a container which has a flexible wall, is configured as a flexible disposable container and has a means for mixing liquids located in flexible disposable containers. To facilitate handling, the disposable container is inserted into a support container supporting its lateral container wall.

U.S. Pat. No. 6,494,613 B2 discloses a flexible disposable container which is arranged in a support container and the liquid medium of which is mixed thoroughly by a mixing device.

Furthermore, U.S. Pat. No. 2,797,903 discloses a container arrangement with a container which has a flexible wall, can be inserted into a support container supporting its lateral container wall and in which liquid medium which has been introduced can be mixed thoroughly. Attached between the lateral container wall and the side wall of the support container are inflatable shaped articles which, outside the mixing process, are intended to detach caked material on the container wall on deformation of said wall.

A drawback of the known containers having a flexible wall is that they do not have for assisting the mixing process any "chicanes" such as are known from containers having rigid walls, for example from DE 692 33 170 T2 or WO 03/012027 A1.

The object of the present invention is therefore to improve the mixing process in the flexible containers by way of the chicanes assisting the mixing process.

In conjunction with a container arrangement having a flexible wall, this object is achieved in that the support container has on its inner support surface surrounding the lateral container wall at lease one chicane or baffle which shapes the lateral container wall and assists the mixing process.

As a result of the arrangement of at least one chicane on the inner support surface of the support container, the container having a flexible wall is provided in a simple and cost-effective manner with a chicane assisting the mixing process. While the disposable container does not have to be provided in a cost-intensive manner with a chicane, the support container having the chicane can be used again and again.

According to a preferred embodiment of the invention, a plurality of chicanes or baffles are arranged on the inner support surface. Although a large number of chicanes is in principle possible, two to four chicanes have proven successful.

According to a further preferred embodiment of the invention, the chicanes are oriented vertically, i.e. parallel to the longitudinal axis of the container. This has the advantage that the container can be inserted into the support container and also removed again relatively easily.

According to a further preferred embodiment of the invention, the chicanes are tilted through an angle relative to the longitudinal axis of the support container. The tilting about the longitudinal axis of the support container leads to a slightly helical formation of the chicanes, thus allowing the flow pattern during the mixing process and also any exchange of gas to continue to be positively influenced.

According to a further preferred embodiment of the invention, the chicane has a run-on surface in the upper region in the vertical direction. Accordingly, a run-out surface can be provided in the lower region. On the one hand, the run-on and run-off surfaces prevent damage to the container having a flexible wall and on the other hand they facilitate the introduction or removal of the container into or from the support container.

According to a further preferred embodiment of the invention, the chicanes are formed integrally with the inner support surface of the support container. For this purpose, the chicanes can for example be formed as a type of beading in the wall of the support container.

According to a further preferred embodiment of the invention, the chicanes are exchangeably fastened to the inner support surface of the support container. This allows high flexibility. The support containers can be used with different chicanes. If necessary, they can also be used without chicanes. With exchangeable chicanes, the support container can easily be adapted to different disposable containers with different mixing devices. It is for example also possible to arrange chicanes in the vertical direction in different regions; this can be advantageous in particular in mixers having mixing elements in various planes.

According to a further preferred embodiment of the invention, the chicanes adhere magnetically to the inner support surface of the support container. For this purpose, the chicanes are made of a ferromagnetic material or have permanent magnets with which they can be fastened to the support surface. The chicanes can however also be made of metal and be held by a permanent magnet which can be opposed in the wall of the support container or from the outside. To improve durability, the chicanes can be coated with plastics material.

On the one hand, magnetic chicanes can be exchanged particularly easily and, on the other hand, they can be fastened without difficulty to various points of the inner support surface. The chicanes can however also be fastened mechanically, for example by screws.

According to a further preferred embodiment of the invention, the chicanes have a rounded cross-sectional shape transversely to their longitudinal axis. The chicanes, which are web-like in their configuration, are formed so as to be convex toward the longitudinal axis of the container. The chicanes can in this case have a cross section which is formed as an elliptical or parabolic or circular portion. At the point of transition to the support surface of the container, the chicane can also be rounded in its formation. This prevents sharp-edged corners in the region of the base of the chicane as well.

Further details of the invention will emerge from the subsequent detailed description and the appended drawings which illustrate by way of example preferred embodiments of the invention.

Figure 1:
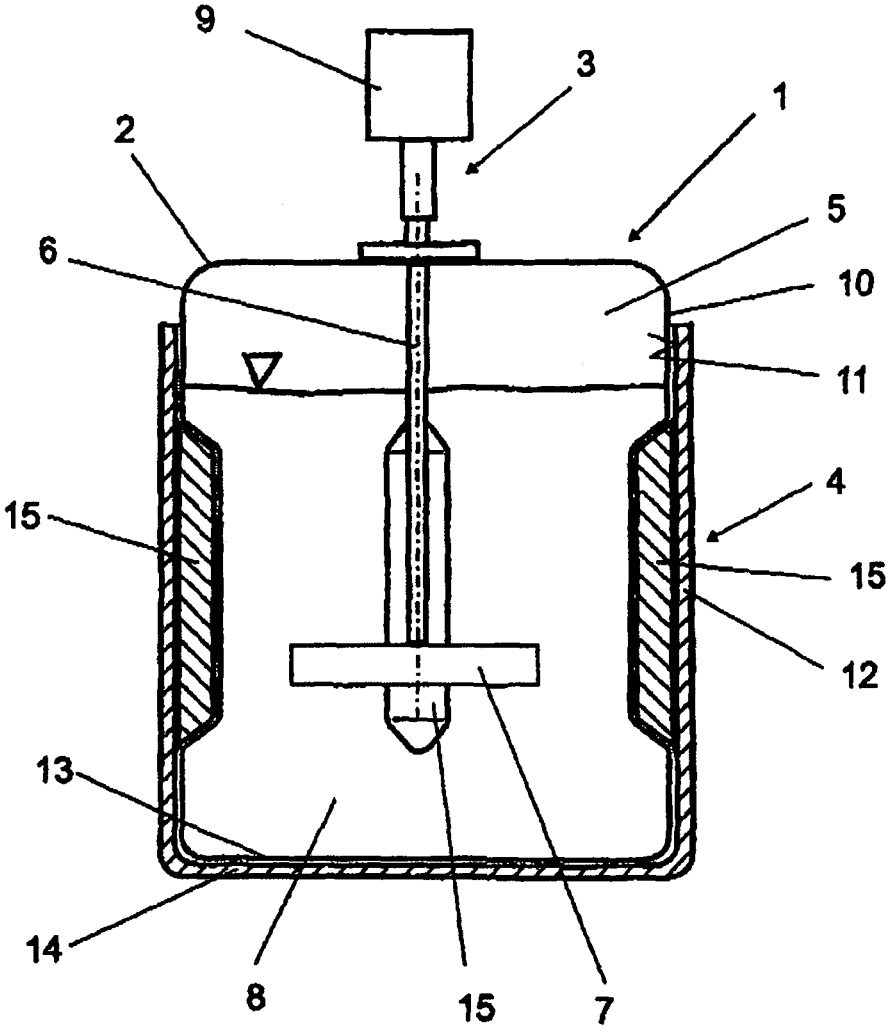
FIG. 1 is a side view in cross section of a container arrangement with a container having a flexible wall with a mixer and a support container.

A container 1 having a flexible wall 2 has a mixer 3 and is located, at least for a mixing process, in a support container 4. The container 1 has a container interior 5 in which the mixer 3 is arranged. A mixing element 7 is arranged at one end of a mixer shaft 6. The mixing element 7 can be part of a rotary mixer, a reciprocating mixer, a magnetic stirrer or a vibratory mixer. The medium 8 to be mixed is also poured into the interior 5. Connections for media to be supplied or to be discharged are not shown. The drive 9 for the mixer 3 is arranged outside the container 1.

Figure 2:
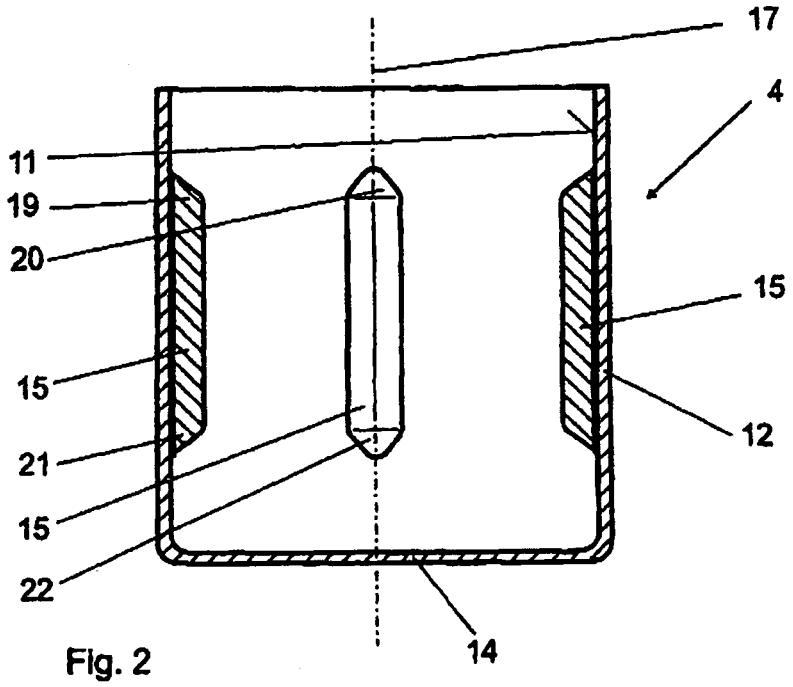
FIG. 2 is a side view in cross section of the support container from FIG. 1.
Figure 3:
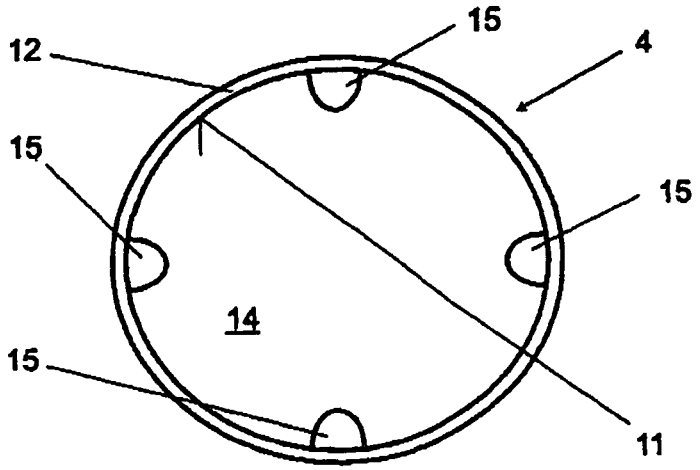
FIG. 3 is a plan view onto the support container from FIG. 2.

The container 1 is inserted into the support container 4 at least for the mixing process. In this case, the lateral container wall 10 of the container 1 rests against an inner support surface 11 of a lateral support container wall 12. The container base 13 of the container 1 rests in this case on the support container base 14 of the support container 4. In the exemplary embodiment, four web-like chicanes 15 are arranged on the inner support surface 11. The chicanes 15 are fastened to the inner support surface 11 of the lateral support container wall using permanent magnets 16. In accordance with FIGS. 2 and 3, the chicanes 15 are in the form of elongate webs which are oriented in the vertical direction, i.e. parallel to the longitudinal axis 17 of the support container. The cross section 18 of the chicanes 15 is convex, i.e. rounded, in its formation relative to the longitudinal axis 17 of the support container. The chicanes 15 have a run-on surface 20 in the upper region 19 in the vertical direction. In the lower region 21 in the vertical direction, the chicanes 15 have a run-out surface 22. The chicanes 15 are coated with plastics material.

Figure 8:
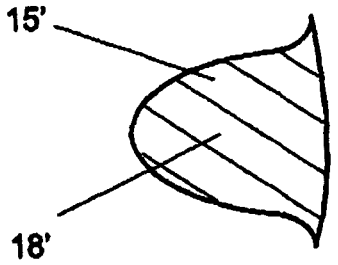
FIG. 8 is a plan view in cross section onto a further chicane.

In accordance with the exemplary embodiment from FIG. 8, the chicanes 15' can have a cross section 18' which is rounded convexly toward the longitudinal axis 17 of the support container and concavely laterally toward the inner support surface 11.

Figure 9:
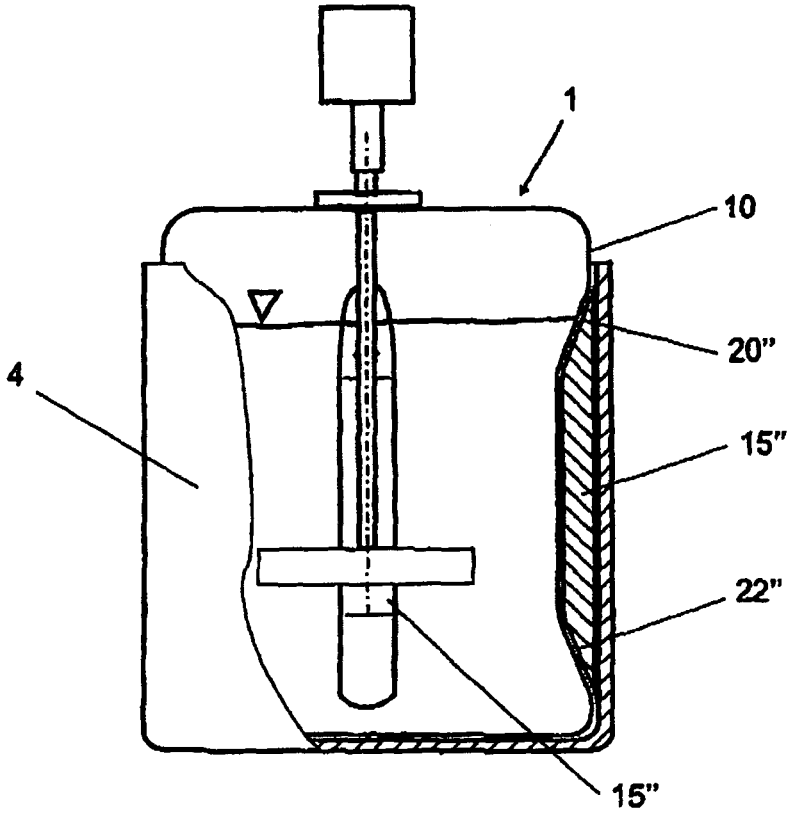
FIG. 9 is a partly cut-away side view of a further container with a mixer and support container.

In accordance with the exemplary embodiment from FIG. 9, the chicanes 15" are formed so as to be longer in the vertical direction than in the exemplary embodiment according to FIG. 1, and the run-on surfaces 20" and run-out surfaces 22" are flatter in their formation.

Figure 4:
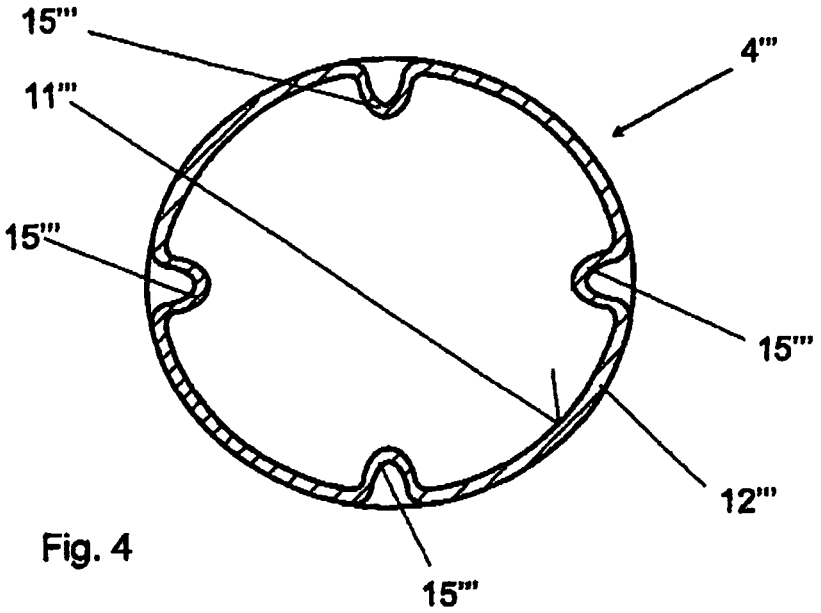
FIG. 4 is a plan view in cross section onto a further support container.
Figure 5:
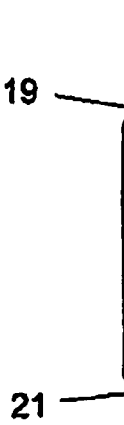
FIG. 5 is a front view of a chicane.
Figure 6:
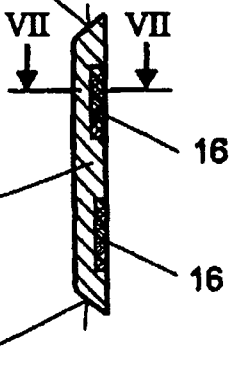
FIG. 6 is a side view in cross section of the chicane from FIG. 5.
Figure 7:
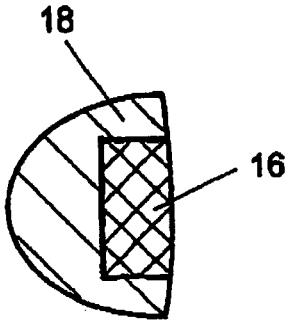
FIG. 7 is a plan view onto the chicane of FIG. 6 taken along the line VII-VII.

According to the exemplary embodiment from FIG. 4, the chicanes 15''' are formed integrally with the lateral container wall 12'''.

The invention claimed is:

1. A container arrangement comprising:

a rigid support container (4) having a closed bottom, an open top and a continuous lateral support container wall (12) with a concave cylindrical inner support surface (11);

chicanes (15, 15', 15", 15''') that are structurally separate from one another and spaced from one another, each of the chicanes (15, 15', 15", 15''') comprising a core (16) that is magnetically attachable to the concave cylindrical inner support surface (11) of the rigid support container (4), each of the chicanes (15, 15', 15", 15''') further being coated with a plastics material and having a convex outwardly facing surface with a shape conforming to a shape defined by the concave cylindrical inner support surface (11) of the lateral container wall (12), the convex outwardly facing surfaces being exchangeably fastened magnetically to the concave cylindrical inner support surface (11) of the lateral container wall (12), each of the chicanes (15, 15', 15", 15''') further having a convex inwardly facing surface projecting inward from the inner support surface (11) of the lateral support container wall (12), each of the chicanes (15, 15', 15", 15''') have opposite top and bottom ends, the top end of each of the chicanes (15, 15', 15", 15''') having a run-on surface (20) tapered out toward the lateral support container wall (12) at a position below the open top of the rigid support container (4), and the bottom end of each of the chicanes (15, 15', 15", 15''') having a run-out surface (22) tapered out toward the lateral support container wall (12); and a disposable container (1) formed from a flexible material and having a flexible lateral container wall (10), the disposable container (1) being in the rigid support container (4) so that the chicanes (15, 15', 15", 15''') shape the flexible lateral container wall (10) of the disposable container (1) inwardly and assist a mixing process of a liquid medium (8) that has been introduced into the disposable container (1), wherein the lateral support container wall (12) above the chicanes (15, 15', 15", 15''') defines an opening area larger than an opening area at the chicanes (15, 15', 15", 15'''), and the run-on surfaces (20), the run-out surfaces (22) and the open area above the chicanes (15, 15', 15", 15''') facilitate introduction and removal of the disposable container (1) through the open top without damage to the disposable container.

2. The container arrangement as claimed in claim 1, wherein the chicanes (15, 15', 15", 15''') are oriented vertically.

3. The container arrangement as claimed in claim 1, wherein the lateral support container wall (12) is generated about a longitudinal axis, and further characterized in that the chicanes (15, 15', 15", 15''') are tilted through an angle relative to the longitudinal axis (17) of the lateral support container wall.

4. The container arrangement as claimed in claim 1, wherein the cores (16) of the chicanes (15, 15', 15''') are made of a ferromagnetic material.

5. The container arrangement as claimed in claim 1, wherein the cores (16) of the chicanes (15, 15', 15''') are made of metal and are fixed by a magnet that is arranged in the wall of the support container (4) or can be arranged from the outside.

6. The container arrangement as claimed in claim 1, wherein the chicanes (15, 15', 15''') are mechanically fastened to the inner support surface (11) of the support container (4).

7. The container arrangement as claimed in claim 1, wherein the chicanes (15, 15', 15", 15''') have a rounded cross-sectional shape transversely to their longitudinal axis.

8. The container arrangement as claimed in claim 1, wherein the closed bottom of the support container (4) has a base wall (14) integral with a lower end of the lateral support container wall (12), the disposable container (1) further having a disposable container base (13) integral with a lower end of the flexible lateral container wall (10), the disposable container base (13) being supported on the base wall (14) of the support container (4).

9. The container arrangement as claimed in claim 1, further comprising a mixer (3) mounted to a top part of the disposable container (1) and projecting into the disposable container (1).

10. A container arrangement comprising:

a rigid support container (4) having a continuous lateral support container wall (12) with a concave cylindrical inner support surface (11); and chicanes (15, 15', 15", 15'") that are structurally separate from one another and spaced from one another, each of the chicanes (15, 15', 15", 15'") comprising a core (16) that is magnetically attachable to the concave cylindrical inner support surface (11) of the rigid support container (4), each of the chicanes (15, 15', 15", 15'") further being coated with a plastics material and having a convex outwardly facing surface with a shape conforming to a shape defined by the concave inner support surface (11) of the lateral container wall (12), the convex outwardly facing surfaces being exchangeably fastened magnetically to the inner support surface (11) of the lateral container wall (12), each of the chicanes (15, 15', 15", 15'") further having a convex inwardly facing surface projecting inward from the inner support surface (11) of the lateral support container wall (12); and a disposable container (1) formed from a flexible material and having a flexible lateral container wall (10) so that the chicanes (15, 15', 15", 15'") shape the flexible lateral container wall (10) of the disposable container (1) inwardly and assist a mixing process of a liquid medium (8) that has been introduced into the disposable container (1).

11. The container arrangement as claimed in claim 10, wherein the cores of the chicanes (15, 15', 15'") are made of metal.

12. The container arrangement as claimed in claim 11, wherein the chicanes (15, 15', 15'") are mechanically fastened to the inner support surface (11) of the lateral container wall (12).

13. The container arrangement as claimed in claim 10, wherein at least one magnet is arranged in or on the lateral container wall (12).

14. The container arrangement as claimed in claim 10, wherein the core (16) of each of the chicanes (15, 15', 15'") comprises a magnet.

* * * * *